US007120380B2

(12) United States Patent
Ferrar et al.

(10) Patent No.: US 7,120,380 B2
(45) Date of Patent: Oct. 10, 2006

(54) ELECTROSTATOGRAPHIC APPARATUS HAVING TRANSPORT MEMBER WITH RELEASE OIL-ABSORBING LAYER

(75) Inventors: Wayne T. Ferrar, Fairport, NY (US); Jeffrey R. Murray, Palmyra, NY (US); Larry H. Judkins, Rochester, NY (US); Cumar Sreekumar, Penfield, NY (US); David M. Rakov, Rochester, NY (US); Lixin Chu, Rochester, NY (US); Douglas E. Garman, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/965,369

(22) Filed: Oct. 14, 2004

(65) Prior Publication Data

US 2005/0105939 A1 May 19, 2005

Related U.S. Application Data

(60) Provisional application No. 60/523,069, filed on Nov. 18, 2003.

(51) Int. Cl.
*G03G 15/20* (2006.01)
*G03G 15/00* (2006.01)

(52) U.S. Cl. ..... 399/322; 399/326; 399/327; 399/401

(58) Field of Classification Search ..... 399/322, 399/320, 325, 326, 327, 328, 400, 401; 428/32.34, 428/32, 34

See application file for complete search history.

(56) References Cited

U.S. PATENT DOCUMENTS

| | | | | |
|---|---|---|---|---|
| 4,120,943 | A | 10/1978 | Iwaisako et al. | 423/628 |
| 4,780,356 | A | 10/1988 | Otouma et al. | 428/212 |
| 4,879,166 | A | 11/1989 | Misuda et al. | 428/212 |
| 5,085,698 | A | 2/1992 | Ma et al. | 106/20 |
| 5,120,609 | A * | 6/1992 | Blaszak et al. | 428/446 |
| 5,157,445 | A | 10/1992 | Shoji et al. | 355/284 |
| 5,406,364 | A | 4/1995 | Maeyama et al. | 355/296 |
| 5,512,409 | A | 4/1996 | Henry et al. | 430/124 |
| 5,605,750 | A | 2/1997 | Romano et al. | 428/304.4 |
| 5,693,442 | A | 12/1997 | Weiss et al. | 430/66 |
| 5,710,964 | A * | 1/1998 | Tombs et al. | 399/303 |
| 5,723,211 | A * | 3/1998 | Romano et al. | 428/32.24 |
| 6,075,965 | A | 6/2000 | Tombs et al. | 399/308 |
| 6,184,911 | B1 | 2/2001 | Tombs et al. | 347/117 |
| 6,197,409 | B1 * | 3/2001 | Bodager et al. | 428/32.24 |
| 6,479,135 | B1 * | 11/2002 | Bermel et al. | 428/32.34 |
| 2002/0061210 | A1 * | 5/2002 | Ashibe et al. | 399/302 |
| 2003/0001937 | A1 * | 1/2003 | Landry-Coltrain et al. | 347/100 |

* cited by examiner

*Primary Examiner*—Hoang Ngo
(74) *Attorney, Agent, or Firm*—Donna Suchy

(57) ABSTRACT

An electrostatographic reproduction apparatus includes: a primary imaging member for producing an electrostatic latent image on a receiver, a development station for applying toner particles to the latent image to form a developed toner image on the receiver, a fuser assembly for fixing the developed toner image to form a fused toner image on the receiver, and a transport member for transporting the receiver to or from the fuser assembly. The transport member includes a substrate and an oil-absorbing layer that contains inorganic particles dispersed in an organic binder and is capable of absorbing release oil applied to the receiver bearing the fused toner image.

32 Claims, 2 Drawing Sheets

ELECTROSTATOGRAPHIC APPARATUS HAVING TRANSPORT MEMBER WITH RELEASE OIL-ABSORBING LAYER

CROSS REFERENCE TO RELATED APPLICATION

Reference is made to and priority claimed from U.S. Provisional Application Ser. No. 60/523,069, filed on Nov. 18, 2003, entitled: ELECTROSTATOGRAPHIC APPARATUS HAVING TRANSPORT MEMBER WITH RELEASE OIL-ABSORBING LAYER.

FIELD OF THE INVENTION

The present invention relates to electrostatographic image reproduction and, more particularly, to an electrostatographic apparatus that includes a transport web provided with a release oil-absorbing layer.

BACKGROUND OF THE INVENTION

Electrostatographic printers produce images by transferring polymeric toner particles from a photoreceptor to a receiver and fixing the toner particles to the receiver with heat and pressure. Various additives and oils are used to aid the transfer of the particles. Silicone oil is commonly used as a release oil because it is thermally stable and incompatible with the toner particles and other polymers in the printer; unfortunately, however, it tends to spread throughout the machine as prints are made. Release oil spread is exacerbated by duplex printing, which entails the application of images to both sides of a receiver sheet. Oil provided to the receiver during application of the first image on one side of a receiver is carried into the printer on the paper transport web in the course of applying the second image to the opposite side, leading to objectionable image artifacts such as non-uniform density and differences in gloss. Details of fuser oil application are given in U.S. Pat. Nos. 5,157,445 and 5,512,409, the disclosures of which are incorporated herein by reference.

Ink-jet printers produce images by ejecting droplets of ink onto receivers that absorb ink. Porous coatings of inorganic particles on the receivers improve the image quality by, for example, causing more rapid drying of the ink, reducing image spread, and producing more uniform ink coverage. Silica and alumina particles incorporated into binder polymers are used for coatings on paper and coatings on clear plastics such as polyethylene terephthalate sheets. While larger particles can be used to produce opaque coatings on paper substrates, smaller particles are required for coatings that are transparent in a binder, which is also desirably transparent and colorless. Microporous ink-jet recording elements prepared using psuedo-boehmite in organic polymer matrices are described in, for example, U.S. Pat. Nos. 5,723,211; 5,605,750; 5,085,698; 4,879,166; and 4,780,356, the disclosures of which are incorporated herein by reference.

Pseudo-boehmite coatings have also been applied to the photoreceptors used in electrophotographic printing. U.S. Pat. No. 5,693,442, the disclosure of which is incorporated herein by reference, describes the incorporation of a nickel metallized dye into an overcoat of pseudo-boehmite to act as a filter to protect the light sensitive element. The inorganic particles and 5 wt. % of the metallized dye in a poly (vinylpyrrolidone) binder form a transparent layer that can be charged under a corona charger and discharged by exposure to actinide radiation.

The mitigation of objectionable image artifacts such as non-uniform density and differences in gloss that result from the spread of release oil from an imaged receiver into the reproduction apparatus, particularly during a duplex printing process, is provided by the present invention.

SUMMARY OF THE INVENTION

An electrostatographic reproduction apparatus provides a primary imaging member for producing an electrostatic latent image on a receiver, a development station for applying toner particles to the latent image to form a developed toner image on the receiver, a fuser assembly for fixing the developed toner image to form a fused toner image on the receiver, and a transport member for transporting the receiver to or from the fuser assembly. The transport member includes a substrate and an oil-absorbing layer that contains inorganic particles dispersed in an organic binder and is capable of absorbing release oil applied to the receiver bearing the fused toner image.

DETAILED DESCRIPTION OF THE INVENTION

Figure 1:
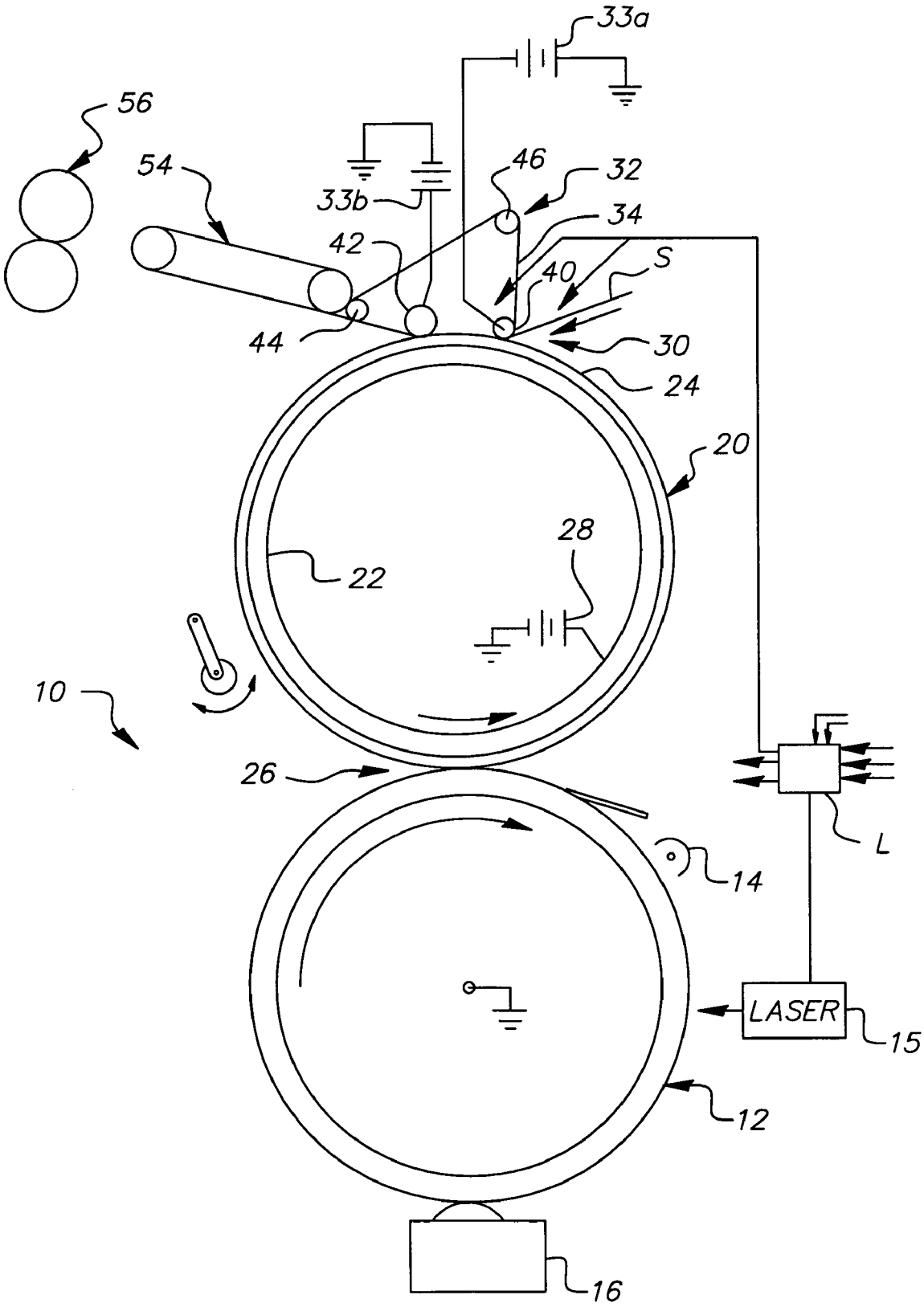
FIG. 1 is a schematic side elevational view of an electrostatographic reproduction apparatus that includes an endless web transport member for moving a receiver to and from a fuser assembly.

FIG. 1 shows an exemplary image-forming electrostatographic reproduction apparatus, designated generally by the numeral 10, that includes a primary image-forming member, for example, a drum 12 having a photoconductive surface, upon which a pigmented marking particle image, or a series of different color marking particle images, is formed. To form images, the outer surface of drum 12 is uniformly charged by a primary charger such as a corona charging device 14, and the uniformly charged surface is exposed by suitable exposure device such as a laser 15 to selectively alter the charge on the surface of the drum 12, thereby creating an electrostatic image corresponding to an image to be reproduced. The electrostatic image is developed by application of pigmented marking particles to the image bearing photoconductive drum 12 by a development station 16 that may include from one to four (or more) separate developing devices.

The marking particle image is transferred (or multiple marking particle images are transferred one after another in registration) to the outer surface of a secondary or intermediate image transfer member, for example, an intermediate transfer drum 20 that includes a metallic conductive core 22 and a compliant layer 24 that has relatively low resistivity. With such a relatively conductive intermediate image transfer member drum 20, transfer of the single color marking particle images to the surface of drum 20 can be accomplished with a relatively narrow nip 26 and a relatively modest potential applied by potential source 28.

A single marking particle image, or a multicolor image comprising multiple marking particle images respectively formed on the surface of the intermediate image transfer member drum 20, is transferred in a single step to a receiver S, which is fed into a nip 30 between intermediate image transfer member drum 20 and a transfer backing member 32. The receiver S is fed from a suitable receiver member supply (not shown) into nip 30, where it receives the marking particle image. Receiver S, exits nip 30 and is transported by a transport web 54 to a fuser assembly 56, where the marking particle image is fixed to receiver S by application of heat and/or pressure. Receiver member S bearing the fused image is transported by transport web 54 to a storage location (not shown) or is inverted by a mechanism (not shown) for transfer of a second image to the reverse side of receiver S.

A transfer-backing member 32 that includes an endless support 34 is entrained about a plurality of support members, for example rollers 40, 42, 44, and 46. Support roller 42 is electrically biased by potential source 33*b* to a level sufficient to efficiently urge transfer of marking particle images from intermediate image transfer member drum 20 to receiver member S. At the same time, support roller 40 is electrically biased, for example to ground potential, or electrically connected to source 28 or a separate potential source 33*a*, to a level sufficient to eliminate ionization and premature transfer upstream of nip 30.

Appropriate sensors (not shown) of any well known type are utilized in reproduction apparatus 10 to provide control signals for apparatus 10, which are fed as input information to a logic and control unit L that produces signals for controlling the timing operation of the various electrographic process stations.

To facilitate release of the fixed toner image from fuser assembly 56, a release agent such as silicone oil is applied to imaged receiver S by a mechanism such as depicted in FIG. 1 of the previously cited U.S. Pat. No. 5,157,445. As already noted, an excess of this oil can be carried to other parts of apparatus 10, especially in the course of duplex printing, resulting in objectionable image artifacts.

In accordance with the present invention, a transport member in an electrostatographic reproduction apparatus 10, depicted in FIG. 1, includes a release oil-absorbing layer disposed on a substrate. Although the transport member is exemplified as a continuous web 54 in FIG. 1, it may take other forms such as, for example, a drum or roller. Apparatus 10 further includes a primary image-forming member, which is exemplified in FIG. 1 as a drum 12 but may be constructed in another form such as, for example, a roller or a belt. The reproduction apparatus optionally includes, operationally associated with the primary image-forming member, an intermediate image transfer member, which is depicted in FIG. 1 as a drum 20 but may also be constructed in another form such as, for example, a roller or a belt.

A transport member provided with an oil-absorbing layer in accordance with the present invention may be included in a full color reproduction apparatus having four toner development stations for cyan, magenta, yellow, and black, as depicted in FIG. 7 of U.S. Pat. No. 6,075,965, the disclosure of which is incorporated herein by reference. A developed multicolor image, following fixing by a fuser assembly, can be transported to a storage site or circulated back for recording an image on the opposite side of the receiver, as described in U.S. Pat. No. 6,184,911, the disclosure of which is incorporated herein by reference.

The inorganic particles included in the oil-absorbing layer preferably include compounds of aluminum selected from the group consisting of aluminum hydroxide, alumina hydrate, aluminum oxide, pseudo-boehmite, boehmite alumina, aluminum salts, and mixtures thereof. More preferably, the inorganic particles include the alumoxane psuedo-boehmite, a xerogel of boehmite represented by the chemical formula AT(O)OH. Pseudo-boehmite can be prepared by procedures described in, for example, U.S. Pat. Nos. 4,120,943 and 5,723,211, the disclosures of which are incorporated herein by reference. The pore characteristics of the xerogel vary depending upon the size and shape of the boehmite colloidal particles. If pseudo-boehmite having a large particle size is used, a layer having a large pore size can be obtained. However larger particles scatter light to various degrees. Smaller particles have smaller pores than the larger particles and tend to be transparent.

An organic binder is employed in the oil-absorbing layer to impart mechanical strength to it. The pore characteristics and transparency of the oil-absorbing layer depend on the particular binder employed. Suitable binders include organic materials such as, for example, starch or one of its modified products, poly(vinyl alcohol) or one of its modified products, SBR latex, NBR latex, cellulose derivatives, quaternary salt polymers ether-substituted poly(phosphazenes), ether-substituted acrylates, ethylene oxide-vinyl alcohol copolymers, poly(vinyl butyral), poly(vinyl formal), polyoxazolines, aliphatic polyamides, and poly(vinylpyrrolidone). The binder, preferably poly(vinyl alcohol), is present in an amount, based on the amount of inorganic particles, of preferably about 3 wt. % to about 30 wt. %, more preferably, about 5 wt. % to about 25 wt. %. If the amount of binder is less than about 3 wt. %, the strength of the oil-absorbing layer tends to be inadequate. On the other hand, if it exceeds 30 wt. %, its porosity tends to be inadequate.

The release oil-absorbing layer of the present invention preferably has a dried thickness of about 1 μm to about 50 μm, more preferably, about 2 μm to about 40 μm. Optionally, the oil-absorbing layer can also incorporate various known additives, including surfactants, pH controllers, anti-foaming agents, lubricants, preservatives, viscosity modifiers, waterproofing agents, dispersing agents, UV absorbing agents, mildew-proofing agents, mordants, antistatic agents, crosslinking agents such as boric acid or borax, and the like. The oil-absorbing layer can also include matting agents such as matte beads comprising crosslinked polystyrene, crosslinked polyacrylate, or polytetrafluoroethylene (TEFLON®) and having a diameter preferably between about 1 μm and about 30 μm, more preferably. between about 2 μm and about 20 μm.

A web substrate for the oil-absorbing layer can be opaque, translucent, or transparent and can have a thickness of, preferably about 50 μm to about 500 μm, more preferably, about 75 μm to about 300 μm. Antioxidants, antistatic agents, plasticizers, and other known additives may be optionally incorporated in the web substrate.

The adhesion of the oil-absorbing layer to the substrate can be improved by corona-discharge treatment of the substrate surface prior to application of the oil-absorbing layer. Alternatively, an undercoating or subbing layer formed from a halogenated phenol or a partially hydrolyzed vinyl chloride-vinyl acetate copolymer and having a thickness (i.e. a dry coat thickness) preferably of less than 2 μm can be applied to the surface of the substrate.

Optionally, an additional backing layer or coating may be applied to the backside of the web substrate, i.e., the side of the substrate opposite the side bearing the oil-absorbing layer, to improve the machine-handling properties of the transport web and controlling the friction and resistivity thereof. Typically, the backing layer includes a binder and a filler, which can be, for example, amorphous and crystalline silicas, poly(methylmethacrylate), hollow sphere polystyrene beads, microcrystalline cellulose, zinc oxide, talc and the like. The filler included in the backing layer is generally less than 2 wt. % of the binder, and the average particle size of the filler material is in the range of 5 μm to 15 μm. Typical of the binders used in the backing layer are polymeric materials such as gelatin, chitosan, acrylates, methacrylates, polystyrenes, acrylamides, poly(vinyl alcohol), poly(vinylpyrrolidone), poly(vinyl chloride)-co-poly(vinylacetate), SBR latex, NBR latex, and cellulose derivatives.

The backing layer can further include an antistatic agent such as, for example, dodecylbenzenesulfonate sodium salt, octylsulfonate potassium salt, oligostyrenesulfonate sodium salt, and laurylsulfosuccinate sodium salt. The antistatic agent is added to the backing layer composition in an amount preferably of 0.1 wt. % to 15 wt. %, based on the weight of the binder.

To form the release oil-absorbing layer on a substrate, a binder is added to the inorganic particles to obtain a slurry, which is coated on the substrate using, for example, a roll coater, an air knife coater, a blade coater, a rod coater, a bar coater, or a comma coater, and then dried. Preferred coating compositions for the oil-absorbing layer contain pseudo-boehmite and poly(vinyl alcohol) in a weight ratio of about 3:1 to about 20:1.

Fluorosurfactants are useful as cleaning aids for inclusion in the oil-absorbing layers, serving to facilitate the removal of toner particles from the surface of the coated substrate. The addition of the fluorosurfactant ZONYL$^R$ FSN, a water-soluble, ethoxylated nonionic fluorosurfactant, to the oil-absorbing layer enables the removal of toner particles that are not readily removed in the absence of the surfactant. The oil-absorbing layer includes the fluorosurfactant preferably in an amount of about 0.01 wt. % to about 10 wt. %, more preferably, about 0.02 wt. % to about 6 wt. %, of the total amount of inorganic particles and organic binder.

Figure 2:
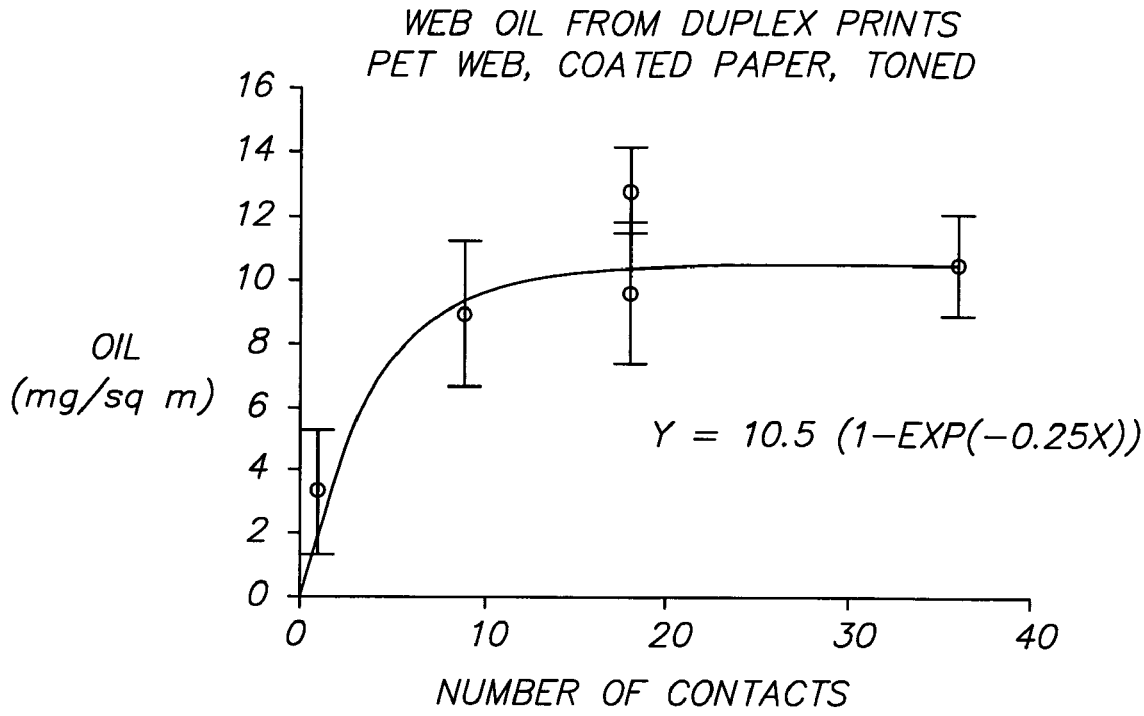
FIG. 2 is a plot of release oil on a transport web versus the number of duplexed contacts obtained using a standard PET web.
Figure 3:
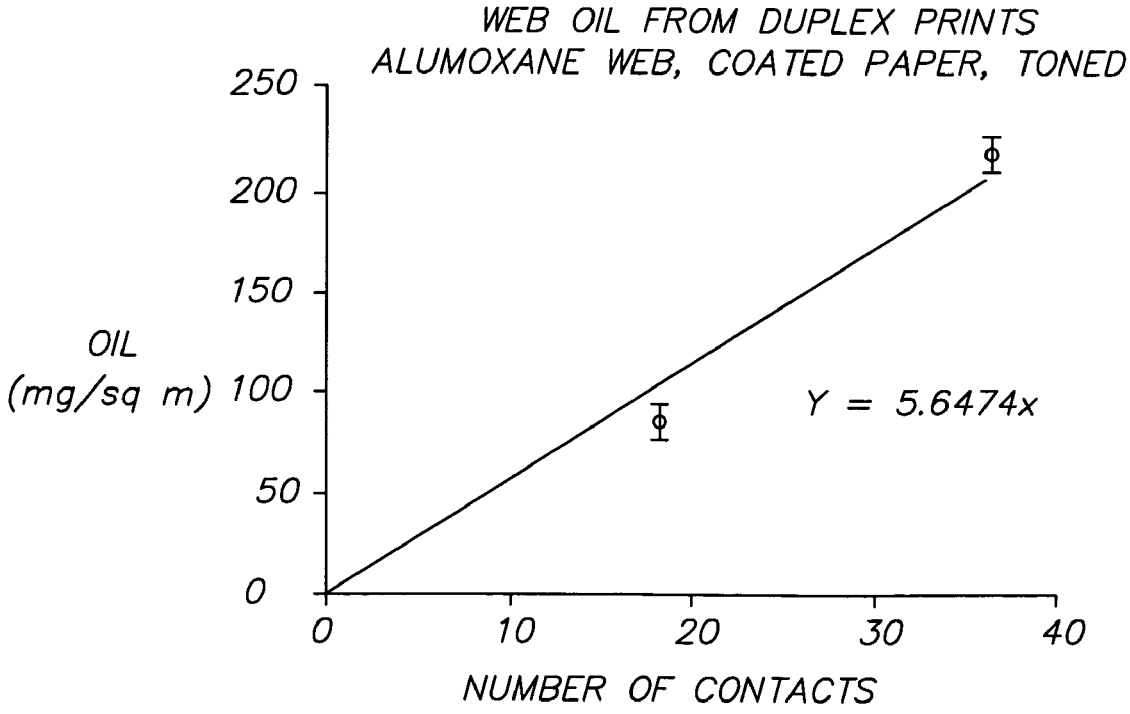
FIG. 3 is a plot of release oil on a transport web versus the number of duplexed contacts obtained using a web containing an oil-absorbent coating in accordance with the present invention.

When printing duplex images on certain described reproduction apparatus, release oil that had been applied to an imaged receiver transfers to the transport web from sheets that are to be printed on the second side. Comparison measurements of oil concentrations as a function of duplex run lengths have been carried out on standard uncoated paper transport webs and on webs provided with an oil-absorbing layer in accordance with the present invention. As shown by the plot in FIG. 2, the oil concentration on a standard uncoated PET web reaches an equilibrium level within 18 duplex contacts (198 duplexed tabloid sheets). The equilibrium level for oil transfer is 16 times higher from toned areas than for untoned areas, which presumably is the origin of the oil artifact. By comparison, paper transport webs provided with an oil-absorbing layer show a linear increase in oil concentration up to the maximum test run of 36 contacts (396 duplexed tabloid sheets) for transfer of oil from toned areas, as shown by the plot in FIG. 3. At this point, the absorbed oil concentration for the transport web of the present invention is 20 times the equilibrium concentration for the standard web. These results indicate that the oil-absorbing coating provides protection from oil artifacts by drawing oil into the porous interior of the coating, reducing the amount of oil available at the surface for transfer to other parts of the machine. On the basis of this mechanism, the useful life of a web would depend on the oil capacity of the coating, which would be expected to depend on the coating thickness. The effective lifetime of a coating can be predicted based on its estimated capacity and the measured oil take up rate.

Oil taken up by the PET web from both toned and untoned areas appears to follow exponential patterns represented by general equation $y=a(1-e^{-bx})$, reaching an equilibrium level after a small number of contacts. Oil from toned paper on the web provided with an oil-absorbing layer increases approximately linearly with the number of contacts over the range of the experiments (using (0,0) as an assumed "data" point). It is suspected that this apparent linear behavior is the low end of an exponential curve that is far from the equilibrium level.

The present invention is further illustrated by the following examples, but it should be understood that the invention is not in any way restricted to such examples.

EXAMPLE 1

A dispersion prepared by mixing 1296 g of a 25 wt. % aqueous pseudo-boehmite slurry obtained from Sasol North America, Inc of Houston, Tex. under the trade name of DISPAL™ 18N4-20, 144 g of a 25 wt. % solution in water of poly(vinyl alcohol) (GL-03 GOHSENOL$^R$, Nippon Gohsei), 4.5 g of ZONYL$^R$ FSN surfactant (40 wt. % active in isopropanol/water), and 560 g of water was coated, using an extrusion hopper, over a subbing layer of acrylonitrile-vinyl chloride-acrylic acid on one side of a 102 μm-thick polyethylene terephthalate film. The dry thickness of the porous pseudo-boehmite layer was 3.8 μm.

EXAMPLE 2

A pseudo-boehmite-containing dispersion similar to that used in Example 1 but containing 18 g of ZONYL$^R$ FSN surfactant (40 wt. % active in isopropanolvwater) was coated on the subbed polyethylene terephthalate film. The dry thickness of the porous pseudo-boehmite layer was 3.3 μm.

EXAMPLE 3

A pseudo-boehmite-containing dispersion similar to that used in Example 1 but containing 1 g of ZONYL$^R$ FSN surfactant (40 wt. % active in isopropanol/water) was coated on the subbed polyethylene terephthalate film. The dry thickness of the porous pseudo-boehmite layer was 4.2 μm.

EXAMPLE 4

A pseudo-boehmite-containing dispersion similar to that used in Example 1 but containing 36 g of ZONYL$^R$ FSN surfactant (40 wt. % active in isopropanol/water) was coated on the subbed polyethylene terephthalate film. The dry thickness of the porous pseudo-boehmite layer was 4.2 μm.

EXAMPLE 5

A pseudo-boehmite-containing dispersion similar to that used in Example 1 but containing 72 g of ZONYL$^R$ FSN surfactant (40 wt. % active in isopropanol/water) was coated on the subbed polyethylene terephthalate film. The dry thickness of the porous pseudo-boehmite layer was 3.2 μm.

EXAMPLE 6

A dispersion prepared by mixing 1152 g of porous, pseudo-boehmite slurry, 288 g of a 25 wt. % solution in water of poly(vinyl alcohol), no ZONYL$^R$ FSN surfactant, and 960 g of water was coated on the subbed polyethylene terephthalate film as described in Example 1. The dry thickness of the porous pseudo-boehmite layer was 2.8 μm.

EXAMPLE 7

A dispersion prepared as described in Example 6 but containing 54 g of ZONYL$^R$ FSN surfactant (40 wt. % active in isopropanol/water), and 960 g of water was coated on the subbed polyethylene terephthalate film as described in Example 1. The dry thickness of the porous pseudo-boehmite layer was 2.8 μm.

EXAMPLE 8

A dispersion prepared by mixing 1296 g of porous, pseudo-boehmite slurry, 72 g of a 25 wt. % solution in water of GOHSENOL$^R$ poly(vinyl alcohol), 360 g of a 5 wt. % solution in water of poly(vinyl alcohol) (ELVINOL$^R$ 71-30, DuPont), 54 g of ZONYL$^R$ FSN surfactant (40 wt. % active in isopropanol/water), and 1872 g of water was coated on the subbed polyethylene terephthalate film as described in Example 1. The dry thickness of the porous pseudo-boehmite layer was 3.1 μm.

EXAMPLE 9

A dispersion prepared by mixing 1296 g of porous, pseudo-boehmite slurry, 144 g of a 25 wt. % solution in water of GOHSENOL$^R$ poly(vinyl alcohol), 0.78 g (2 wt. %) of 2,3-dihydroxy-1,4-dioxane, 54 g of ZONYL$^R$ FSN surfactant (40 wt. % active in isopropanol/water), and 960 g of water was coated on the subbed polyethylene terephthalate film as described in Example 1. The dry thickness of the porous pseudo-boehmite layer was 2.4 μm.

EXAMPLE 10

A dispersion prepared by mixing 1296 g of porous, pseudo-boehmite slurry, DISPAL™ 23N4-20 (smaller particle size than the DISPAL™ 18N4-20 used in the other examples), 144 g of a 5 wt. % solution in water of poly(vinyl alcohol) (ELVINOL$^R$ 71-30, DuPont), 72 g of ZONYL$^R$ FSN surfactant (40 wt. % active in isopropanol/water), and 2000 g of water was coated on the subbed polyethylene terephthalate film as described in Example 1. The dry thickness of the porous pseudo-boehmite layer was 2.3 μm.

EXAMPLE 11

A dispersion prepared by mixing 396 g of a 25 wt. % aqueous pseudo-boehmite slurry, 110 g of a 10 wt. % solution of poly(vinyl alcohol) (KH-20 GOHSENOL$^R$, Nippon Gohsei), and 0.055 g of ZONYL$^R$ FSN surfactant (40 wt. % active in isopropanol/water) was coated as in Example 1. The slurry employed in the dispersion was previously prepared by adding 250 g of DISPAL™ 18N4-80 alumina particles to 750 g of stirred deionized water. The porous pseudo-boehmite layer had a dry thickness of 6.0 μm and an oil capacity, measured after 10 minutes exposure to oil, of 1330 mg/m$^2$.

EXAMPLE 12

To the coated substrate layer described in Example 11 was applied an additional coating of the dispersion from Example 11 to produce a porous pseudo-boehmite layer having a total thickness of 20 μm and a very high measured oil capacity, measured after 10 minutes exposure, of 4290 mg/m$^2$.

EXAMPLE 13

A dispersion prepared by mixing 1162 g of a 25 wt. % aqueous pseudo-boehmite slurry, 330 g of a 10 wt. % solution of poly(vinyl alcohol) (KH-20 GOHSENOL$^R$, Nippon Gohsei); 6.6 g of 2,3-dihydroxy-1,4-dioxane, and 0.16 g of ZONYL$^R$ FSN surfactant (40 wt. % active in isopropanol/water) was coated on a subbed polyethylene terephthalate film, as described in Example 1. The slurry was previously prepared by adding 500 g of DISPAL™ 18N4-80 alumina particles to 1500 g of stirred deionized water. The dry thickness of the porous pseudo-boehmite layer was 12 μm and had an oil capacity, measured after 10 minutes exposure, of 1510 mg/m$^2$.

EXAMPLE 14

A dispersion prepared by mixing 810 g of a 25 wt. % aqueous pseudo-boehmite slurry DISPAL™ 18N4-20, 90 g of a 25 wt. % solution of poly(vinyl alcohol) (GL-03 GOHSENOL$^R$, Nippon Gohsei); 33.7 g of ZONYL$^R$ FSN surfactant (40 wt. % active in isopropanol/water), and 0.45 g (0.2 wt. %) of 19-μm polystyrene beads crosslinked with 5 wt. % divinylbenzene was coated as described in Example 1. The dry thickness of the porous pseudo-boehmite layer was 7.9 μm.

Comparative Example 1

This comparative example includes the 102 μm-thick polyethylene terephthalate film with a subbing layer of acrylonitrile-vinyl chloride-acrylic acid on the inside of the continuous web, as described in Example 1.

Comparative Example 2

A 12 wt. % solution of GOHSENOL$^R$ GL03 polyvinyl alcohol in water was coated, using an extrusion hopper, on the subbed polyethylene terephthalate film described in Example 1. The dry thickness of the polyvinyl alcohol layer was 4.5 μm.

The effectiveness of the alumoxane coatings in delaying the onset of silicone oil streaks is shown in TABLE 1. The oil was deposited at a low rate, a high rate, or a combination of first a low rate and then a high rate. A typical test was carried out as follows. An initial burst of 198 sheets with toned stripes on them was introduced into the printer. These tabloid sheets touched the web the first time during imaging on side one (no oil left on web). During imaging on the second pass (duplex) the fused side is in contact with the web. Finally, 2 sets of flat fields were done (i.e. 8 sheets simplex). Thus, the total of sheets used, total of sheets through the process, oil contacts per 11 web frames, and A4 images would be 206, 404, 18, and 808 respectively. The printing was continued until the image artifacts of the original stripes were observed on the prints.

Examples 1 and 2 were run for short durations and terminated prematurely before oil streaks were observed, as they were superior to the Comparative Examples.

TABLE 1

| Example | Oil Rate | Thickness (μm) | Onset of Streaks (No. of A4 Prints) |
|---|---|---|---|
| Comparative Example 1 | low | 0 | 700 |
| Comparative Example 2 | low | 4.5 | 700 |
| Example 1 | low | 3.8 | >800 |
| Example 2 | low | 3.3 | >800 |
| Example 3 | high | 4.2 | 4000 |
| Example 4 | high | 4.2 | 8000 |
| Example 5 | low | 3.2 | <8000 |
| Example 6 | low and high | 2.8 | <8000 |
| Example 7 | low and high | 2.8 | 8000 |
| Example 8 | low and high | 3.1 | 4600 |
| Example 9 | low and high | 2.4 | 8000 |
| Example 10 | low and high | 2.3 | 8000 |
| Example 11 | | 6.0 | |
| Example 12 | high | 20 | >8000 |
| Example 13 | | 12 | |
| Example 14 | low and high | 7.9 | >8000 |

Low rate oiler applies 2 mg of fuser oil per A4 sheet
High rate oiler applies 5 mg of fuser oil per A4 sheet Testing of Comparative Example 1, which had no additional coating on the subbed substrate, resulted in oil streak image artifacts being observed after about 700 prints containing fuser oil had been put into the printer. With Comparative Example 2, which has a 4.5 μm-thick layer of poly(vinyl alcohol) coated on the substrate, about the same number of prints containing fuser oil caused the oil streak artifact.

In contrast to the Comparative Examples, the alumoxane coated transport webs all ran at least 800 prints, and some more than 8000 before the image artifact was observed. With the exception of Example 6, the coatings with the lower molecular weight GL-03 binder contained at least 0.5 wt. % of the ZONYL$^R$ surfactant as a percentage of the total pseudo-boehmite-poly(vinyl alcohol) mixture. The coating of Example 6, which contained 80 wt. % pseudo-boehmite and 20 wt. % of poly(vinyl alcohol) binder but no fluorosurfactant, was able to be cleaned of toner and did not show image artifacts until almost 8000 prints were produced. Coatings containing the higher molecular weight poly(vinyl alcohol) binder also did not require ZONYL$^R$ surfactant for cleaning, as shown by Example 12.

The binder layer of Example 8 contained 10 wt. % of a 50:50 mixture of GL-03 GOHSENOL$^R$ poly(vinyl alcohol) and ELVINOL$^R$ 71-30 high molecular weight poly(vinyl alcohol). The higher molecular weight component would be expected to increase the mechanical properties of the alumoxane layer, resulting in less wear of the coating and therefore longer life of the paper transport belt, and also resulting in lower levels of debris requiring removal by the printer cleaning system.

The coating composition of Example 9 contained 2 wt. % of 2,3-dihydroxy-1,4-dioxane crosslinking agent, which would be expected to improve the mechanical properties of the oil-absorbing layer. The coating remained flexible and continued to perform well in terms of preventing image artifact due to silicone oil.

The coating composition of Example 10 contained smaller alumoxane particles than those used in the other coatings. The smaller particle size produced a coating with greater transparency as well as increased toughness resulting from better reinforcement with the higher surface area.

The coating composition of Example 11 included a slurry prepared in deionized water from dry DISPAL™ particles and a low level of ZONYL$^R$ FSN fluorosurfactant.

The oil-absorbing layer in Example 12 was coated in two stages, giving a layer with a total dry thickness of 20 μm. ZONYL$^R$ FSN fluorosurfactant was present in an amount of 0.02 wt. %. This coating produced extremely good results, a total of 76,000 prints being run before oil streak artifacts were detected.

The coating composition of Example 13 was similar to that of Example 9 but contained a much higher concentration (20 wt. %) of 2,3-dihydroxy-1,4-dioxane crosslinking agent.

The coating composition of Example 14 included 19-μm crosslinked polystyrene beads as a matting agent.

The invention has been described in detail with particular reference to preferred embodiments thereof, but it will be understood that variations and modifications can be effected within the spirit and scope of the invention, which is defined by the claims that follow.

What is claimed is:

1. An electrostatographic reproduction apparatus comprising:

a primary imaging member for producing an electrostatic latent image on a receiver;

a development station for applying toner particles to said latent image, thereby forming a developed toner image on said receiver;

a fuser assembly for fixing said developed toner image, thereby forming a fused toner image on said receiver; and a transport member for transporting said receiver to or from said fuser assembly, said transport member comprising a substrate bearing an oil-absorbing layer that comprises inorganic particles, including at least one compound of alumina, dispersed in an organic binder, said layer being capable of absorbing release oil applied to said receiver bearing said fused toner image.

2. The electrostatographic reproduction apparatus of claim 1, wherein said oil absorbing layer further includes a fluorosurfactant.

3. The electrostatographic reproduction apparatus of claim 2, wherein said inorganic particles comprise a compound of aluminum selected from the group consisting of aluminum hydroxide, alumina hydrate, aluminum oxide, pseudo-boebmite, boebmite alumina, aluminum salts, and mixtures thereof.

4. The electrostatographic reproduction apparatus of claim 1, wherein said inorganic particles comprise pseudo-boebmite.

5. The electrostatographic reproduction apparatus of claim 1, wherein said organic binder is selected from the group consisting of starch or a modification product thereof, poly(vinyl alcohol) or a modification product thereof, SBR latex, NBR latex, cellulose derivatives, quatemary salt polymers, ether-substituted poly(phosphazenes), ether-substituted acrylates, ethylene oxide-vinyl alcohol copolymers, poly(vinyl butyral), poly(vinyl formal), polyoxazolines, aliphatic polyamides, poly(vinylpyrrolidone), and mixtures thereof.

6. The electrostatographic reproduction apparatus of claim 5, wherein said organic binder is poly(vinyl alcohol).

7. The electrostatographic reproduction apparatus of claim 1, wherein said oil-absorbing layer includes said organic binder in an amount of about 3 wt. % to about 30 wt. %, of said inorganic particles.

8. The electrostatographic reproduction apparatus of claim 7, wherein said oil-absorbing layer includes said organic binder in an amount of about 5 wt. % to about 25 wt. %, of said inorganic particles.

9. The electrostatographic reproduction apparatus of claim 4, wherein said oil-absorbing layer comprises pseudo-boehmite and poly(vinyl alcohol) in a weight ratio of about 3:1 to about 20:1.

10. The electrostatographic reproduction apparatus of claim 1, wherein said oil-absorbing layer has a dried thickness of about 1 μm to about 50 μm.

11. The electrostatographic reproduction apparatus of claim 10, wherein said oil-absorbing layer has a dried thickness of about 2 μm to about 40 μm.

12. The electrostatographic reproduction apparatus of claim 1, wherein said substrate bearing said oil-absorbing layer is selected from the group consisting of a continuous web, a drum, and a roller.

13. The electrostatographic reproduction apparatus of claim 12, wherein said substrate bearing said oil-absorbing layer is a continuous web.

14. The electrostatographic reproduction apparatus of claim 13, wherein said continuous web has a thickness of about 50 μm to about 500 μm.

15. The electrostatographic reproduction apparatus of claim 14, wherein said continuous web has a thickness of about 75 μm to about 300 μm.

16. The electrostatographic reproduction apparatus of claim 13, wherein said continuous web includes a subbing layer.

17. The electrostatographic reproduction apparatus of claim 10, wherein said oil-absorbing layer further comprises a fluorosurfactant.

18. The electrostatographic reproduction apparatus of claim 17, wherein said fluorosurfactant is a water-soluble, ethoxylated nonionic fluorosurfactant.

19. The electrostatographic reproduction apparatus of claim 17, wherein said oil-absorbing layer contains said fluorosurfactant in an amount of about 0.01 wt. % to about 10 wt. % of the total amount of said inorganic particles and said organic binder.

20. The electrostatographic reproduction apparatus of claim 19, wherein said oil-absorbing layer contains said fluorosurfactant in an amount of about 0.02 wt. % to about 6 wt. % of the total amount of said inorganic particles and said organic binder.

21. The electrostatographic reproduction apparatus of claim 1, wherein said transport member is adapted for duplex printing.

22. The electrostatographic reproduction apparatus of claim 1, wherein said oil-absorbing layer further comprises matte beads.

23. The electrostatographic reproduction apparatus of claim 22, wherein said matte beads comprise crosslinked polystyrene, crosslinked polyacrylate, or poly(tetrafluoroethylene) and have a diameter between about 1 μm and about 30 μm.

24. The electrostatographic reproduction apparatus of claim 23, wherein said matte beads have a diameter between about 2 μm and about 20 μm.

25. The electrostatographic reproduction apparatus of claim 1, wherein said oil-absorbing layer further comprises a crosslinking agent.

26. The electrostatographic reproduction apparatus of claim 25, wherein said crosslinking agent comprises 2,3-dihydroxy-1,4-dioxane.

27. An electrostatographic reproduction apparatus comprising:

a primary imaging member for producing an electrostatic latent image on a receiver;

a development station for applying toner particles to said latent image, thereby forming a developed toner image on said receiver;

a fuser assembly for fixing said developed toner image, thereby forming a fused toner image on said receiver; and a transport member for transporting said receiver to or from said fuser assembly, said transport member comprising a substrate bearing an oil-absorbing layer that comprises inorganic particles, including at least one compound of aluminum with a particle size sufficiently small to be essentially transparent, dispersed in an organic binder, said layer being capable of absorbing release oil applied to said receiver bearing said fused toner image.

28. The electrostatographic reproduction apparatus of claim 27, wherein said oil absorbing layer further includes a fluorosurfactant.

29. The electrostatographic reproduction apparatus of claim 27, wherein said oil-absorbing layer has a dried thickness of about 1 μm to about 50 μm.

30. The electrostatographic reproduction apparatus of claim 27, wherein said oil-absorbing layer comprises pseudo-boehmite particles, dispersed in an organic binder.

31. The electrostatographic reproduction apparatus of claim 30, wherein said pseudo-boebmite particles comprise a dispersed particle size of less than 0.5 microns.

32. The electrostatographic reproduction apparatus of claim 30, wherein said oil absorbing layer further includes a fluorosurfactant.

* * * * *